US009589470B2

(12) United States Patent
Kuwabara

(10) Patent No.: US 9,589,470 B2
(45) Date of Patent: Mar. 7, 2017

(54) METHOD AND APPARATUS FOR DETECTING VEHICLE RUNNING IN BLIND SPOT, AND METHOD AND APPARATUS FOR GIVING WARNING IN CHANGING CRUISING LANE

(71) Applicant: DENSO CORPORATION, Kariya, Aichi-pref. (JP)

(72) Inventor: Tatsuru Kuwabara, Takahama (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 55 days.

(21) Appl. No.: 14/028,826

(22) Filed: Sep. 17, 2013

(65) Prior Publication Data

US 2014/0081566 A1 Mar. 20, 2014

(30) Foreign Application Priority Data

Sep. 18, 2012 (JP) ..... 2012-204412

(51) Int. Cl.
*G08G 1/16* (2006.01)

(52) U.S. Cl.
CPC ..... *G08G 1/167* (2013.01)

(58) Field of Classification Search
None
See application file for complete search history.

(56) References Cited

U.S. PATENT DOCUMENTS 3,708,668 A * 1/1973 Tilley ..... G05D 1/0244 180/169
6,038,496 A * 3/2000 Dobler ..... B60T 7/22 250/559.06
7,158,051 B2 * 1/2007 Strumolo ..... B60Q 9/008 180/167
7,161,472 B2 * 1/2007 Strumolo ..... G01V 3/15 180/167

(Continued)

FOREIGN PATENT DOCUMENTS

JP 2000-214256 8/2000
JP 2005-125933 5/2005

OTHER PUBLICATIONS

JP,2005-125933,A machine translation dated Aug. 6, 2014 from http://www4.ipdl.inpit.go.jp/Tokujitu/tjsogodbenk.ipdl.*

*Primary Examiner* — Jean-Paul Cass
(74) *Attorney, Agent, or Firm* — Harness, Dickey & Pierce, P.L.C.

(57) ABSTRACT

An apparatus for detecting a vehicle running in a blind spot detects, with a predetermined accuracy, a first target position of a target which is present in a first detection area that extends obliquely rearward of the vehicle, detects, with an accuracy lower than the predetermined accuracy, a second target position related to a target which is present in a second detection area adjacent to the first detection area; calculates a first estimated position that corresponds to a subsequent position of the target that has been detected by the detection section as the first target position; and adopts the first estimated position as a position of the target when the first (Continued)

estimated position is included in a predetermined range centering on the second target position, adopts the second target position as a position of the target when the first estimated position is outside the predetermined range.

20 Claims, 9 Drawing Sheets

(56) References Cited

U.S. PATENT DOCUMENTS 7,720,580 B2 * 5/2010 Higgins-Luthman ..... B60R 1/00 250/208.1
8,004,425 B2 * 8/2011 Hoek ..... G01P 1/08 340/435
8,058,980 B2 * 11/2011 Yanagi ..... B60R 1/00 340/435
8,134,637 B2 * 3/2012 Rossbach ..... G01S 17/89 348/336
8,145,413 B2 * 3/2012 Shida ..... B60R 1/00 382/104
8,346,437 B2 * 1/2013 Hayakawa ..... B60W 30/12 180/167
8,386,156 B2 * 2/2013 Miller ..... G08G 1/08 340/907
8,706,352 B2 * 4/2014 Hayakawa ..... B60T 8/17557 340/435
8,749,404 B2 * 6/2014 Augst ..... G06K 9/2036 340/436
2002/0067287 A1 * 6/2002 Delcheccolo ..... B60K 31/0008 340/901
2003/0151541 A1 * 8/2003 Oswald ..... B60R 21/01538 342/70
2004/0246113 A1 * 12/2004 Strumolo ..... G01V 3/15 340/435
2009/0059726 A1 * 3/2009 Okuda ..... G01S 7/521 367/178
2009/0079553 A1 * 3/2009 Yanagi ..... B60R 1/00 340/435
2010/0021011 A1 * 1/2010 Shida ..... B60R 1/00 382/104
2010/0073480 A1 * 3/2010 Hoek ..... G01P 1/08 348/148
2010/0289632 A1 * 11/2010 Seder ..... G01S 13/723 340/436
2010/0318263 A1 * 12/2010 Hayakawa ..... B60T 8/17557 701/41
2011/0090339 A1 * 4/2011 Higgins-Luthman ..... B60R 1/00 348/148
2011/0279256 A1 * 11/2011 Higgins-Luthman ..... B60R 1/00 340/465
2012/0062745 A1 * 3/2012 Han ..... B62D 15/029 348/148
2012/0089299 A1 * 4/2012 Breed ..... B60C 11/24 701/36
2012/0098746 A1 * 4/2012 Ogawa ..... G06F 3/0428 345/158
2012/0130595 A1 * 5/2012 Hayakawa ..... B60W 30/12 701/42
2012/0140078 A1 * 6/2012 Higgins-Luthman ..... B60R 1/00 348/148
2012/0209505 A1 * 8/2012 Breed ..... G01C 21/3697 701/409
2014/0081566 A1 * 3/2014 Kuwabara ..... G08G 1/167 701/300
2015/0061895 A1 * 3/2015 Ricci ..... H04W 4/22 340/902
2015/0185319 A1 * 7/2015 Matsuura ..... G08G 1/166 73/627
2015/0232065 A1 * 8/2015 Ricci ..... B60R 25/01 701/36
2015/0355311 A1 * 12/2015 O'Hagan ..... G01S 5/021 340/539.13

* cited by examiner

METHOD AND APPARATUS FOR DETECTING VEHICLE RUNNING IN BLIND SPOT, AND METHOD AND APPARATUS FOR GIVING WARNING IN CHANGING CRUISING LANE

CROSS-REFERENCE TO RELATED APPLICATION

This application is based on and claims the benefit of priority from earlier Japanese Patent Application No. 2012-204412 filed Sep. 18, 2012, the description of which is incorporated herein by reference.

BACKGROUND OF THE INVENTION

Technical Field of the Invention

The present invention relates to a method and apparatus for detecting a vehicle running in a blind spot of the vehicle, and a method and apparatus for giving a warning when changing cruising lane.

Related Art

It is well known that an inner rearview mirror (rearview mirror) and outer view mirrors (door mirrors or fender mirrors) in a vehicle can have a blind spot that corresponds to a rearward area on the left or right side of the vehicle. For detecting a vehicle running in such a blind spot and for calling attention of the driver to this, a patent document JP-A-2000-214256, for example, suggests an apparatus for detecting a vehicle running in a blind spot. According to this apparatus, the driver can notice the presence of a vehicle which is running in the blind spot and has a possibility of inviting a collision in changing cruising lane. This apparatus is able to eliminate the driver's uneasiness when the driver changes lanes.

The apparatus for detecting a vehicle running in a blind spot disclosed in the above patent document detects the position of a nearby vehicle on the basis of the parallax of images picked up by a plurality of CCD (charge coupled device) cameras installed in the vehicle equipped with the apparatus. The above patent document also discloses use of a laser radar or a milliwave radar sensor to detect a vehicle that runs in a blind spot.

The milliwave radar may be used for configuring a blind spot warning (BSW) device to detect a vehicle that runs in a blind spot and to warn the driver of the presence of the vehicle. With this configuration, the vehicle which runs in a far distance in a blind spot can be detected with high accuracy.

However, detection of a nearby vehicle (hereinafter referred to as "target") using a milliwave radar raises a problem that the range of high-accuracy detection is limited. For example, the accuracy of detection is high only in a predetermined angle range as viewed from the milliwave radar. In other words, high detection accuracy is ensured for a target far from the milliwave radar, while the accuracy of detection is low for a nearby target.

The blind spot of a driver may very often extend over a wider range exceeding the range in which high detection accuracy of the radar is ensured. For this reason, there is a concern that the driver may be informed of a detection position of a target, which has a large difference compared to the actual position of the target.

It is thus desired to provide an apparatus being suitable for detecting other vehicles running in a blind spot, the apparatus exerting high detection accuracy in an actual blind spot, and to provide an apparatus being suitable for giving a warning in changing cruising lane to a driver.

SUMMARY

For this purpose, in the present disclosure, an exemplary embodiment is provided as an apparatus for detecting a vehicle running in a blind spot. The apparatus includes a detection section, an estimation section and a determination section. The detection section detects, with a predetermined accuracy, a first target position related to a target which is present in a first detection area that extends obliquely rearward of the vehicle. The detection section also detects, with accuracy lower than the predetermined accuracy, a second target position related to a target which is present in a second detection area adjacent to the first detection area. The estimation section calculates a first estimated position that is a subsequent position related to the target that has been detected by the detection section as the first target position. The determination section adopts the first estimated position as a position related to the target when the first estimated position is included in a predetermined range centering on the second target position. Also, the determination section adopts the second target position as a position related to the target when the first estimated position is outside the predetermined range.

In the apparatus for detecting a vehicle running in a blind spot according to the exemplary embodiment, the first estimated position is adopted as a position related to the target when the first estimated position is included in the predetermined range centering on the second target position. Also, the second target position is adopted as a position related to the target when the first estimated position is outside the predetermined range. Thus, detection accuracy is enhanced with respect to a target in the second detection area. Further, the second detection area can be configured as a range in which desired detection accuracy is ensured, thereby reducing a low-accuracy detection range.

The second target position and the first estimated position have an error compared to an actual position related to a target. The error of the first estimated position tends to become larger in proportion to the time elapsed from the start of the estimation. The degree of the error of the second target position is substantially constant, irrespective of the elapsed time, but is larger than the degree of the error that the first estimated position may have before the expiration of a predetermined time from the start of the estimation.

Therefore, when the first estimated position is included in the predetermined range centering on the second target position, the first estimated position having a comparatively small error is adopted as the position related to the target. On the other hand, when the first estimated position is outside the predetermined range, the second target position having a relatively large error is adopted as the position related to the target. With this configuration, the detection accuracy is enhanced with respect to the target in the second detection area.

In the present disclosure, as an exemplary embodiment, an apparatus for giving a warning in changing cruising lane is provided. The apparatus for giving a warning in changing cruising lane includes the apparatus for detecting a vehicle running in a blind spot, as described above, a judgment section and a warning section. The judgment section judges whether or not information adopted by the determination section meets a warning condition. The warning section gives a warning when the judgment section judges that the warning condition is satisfied.

The apparatus for giving a warning in changing cruising lane according to the exemplary embodiment includes the apparatus for detecting a vehicle running in a blind spot that is the exemplary example. Thus, in addition to the enhancement of the detection accuracy with respect to a vehicle (i.e. target) running in a blind spot, which affords a ground of giving a warning, the range in which detection accuracy is ensured can be increased.

According to the apparatus for detecting a vehicle running in a blind spot and the apparatus for giving a warning in changing cruising lane of the present disclosure, when a first estimated position is included in a predetermined range centering on a second target position, the first estimated position is adopted as a position related to the target. Further, when the first estimated position is outside the predetermined range, the second target position is adopted as a position related to the target. Thus, advantages specific to the present disclosure can be enjoyed, the advantages being that detection accuracy is enhanced with respect to a target, and the range in which desired detection accuracy is ensured can be increased.

DETAILED DESCRIPTION OF THE PREFERRED EMBODIMENTS

Figure 1:
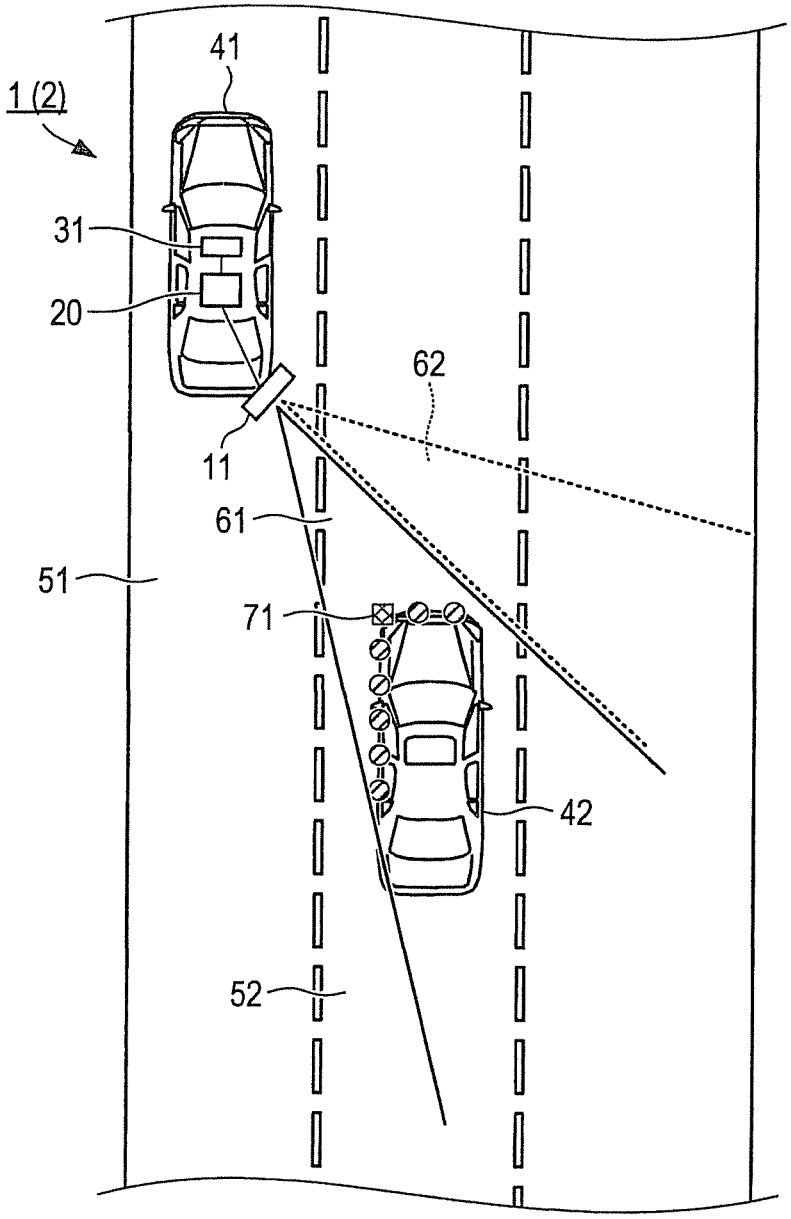
FIG. 1 shows a schematic diagram illustrating a concept of an apparatus for giving a warning in changing cruising lane, according to an embodiment of the present invention.

With reference to the accompanying drawings, hereinafter is described an apparatus for giving a warning in changing cruising lane, which includes an apparatus for detecting a vehicle running in a blind spot, according to an embodiment of the present invention. FIG. 1 shows a schematic diagram illustrating a concept of an "apparatus for giving a warning in changing cruising lane" (hereinafter also just referred to as "warning apparatus"), according to an embodiment of the present invention. The warning apparatus 1 according to the present embodiment supports a lane change operation while the vehicle equipped with the apparatus 1 is driven. As shown in FIG. 1, a vehicle 41 runs in a lane 51 (left lane). Also, another vehicle (i.e. target) 42 runs in a passing lane 52 (i.e. center lane) adjacent to the lane 51 and approaches the vehicle 41 from behind. An "apparatus for detecting a vehicle running in a blind spot" (hereinafter also just referred to as "detection apparatus") installed in the vehicle 41 detects the vehicle 42 and warns a driver of the vehicle 41 that the vehicle 42 is present and/or approaching to the vehicle 41. By giving such a warning, the driver's attention is drawn to the vehicle 42 when the driver is tempted to change a cruising lane 51 to a nearby passing lane 52.

Specifically, a warning area is set as a blind spot of the driver of the vehicle 41. In other words, a warning area is set covering the passing lane 52 and extending rearward on the right side or the left side of the vehicle 41. When the vehicle 42 enters the warning area and keeps running therein, the driver of the vehicle 41 is warned of the presence of the vehicle 42 by the warning apparatus 1. In FIG. 1, the blind spot corresponds to areas 61 and 62 defined by the radial lines.

Figure 2:
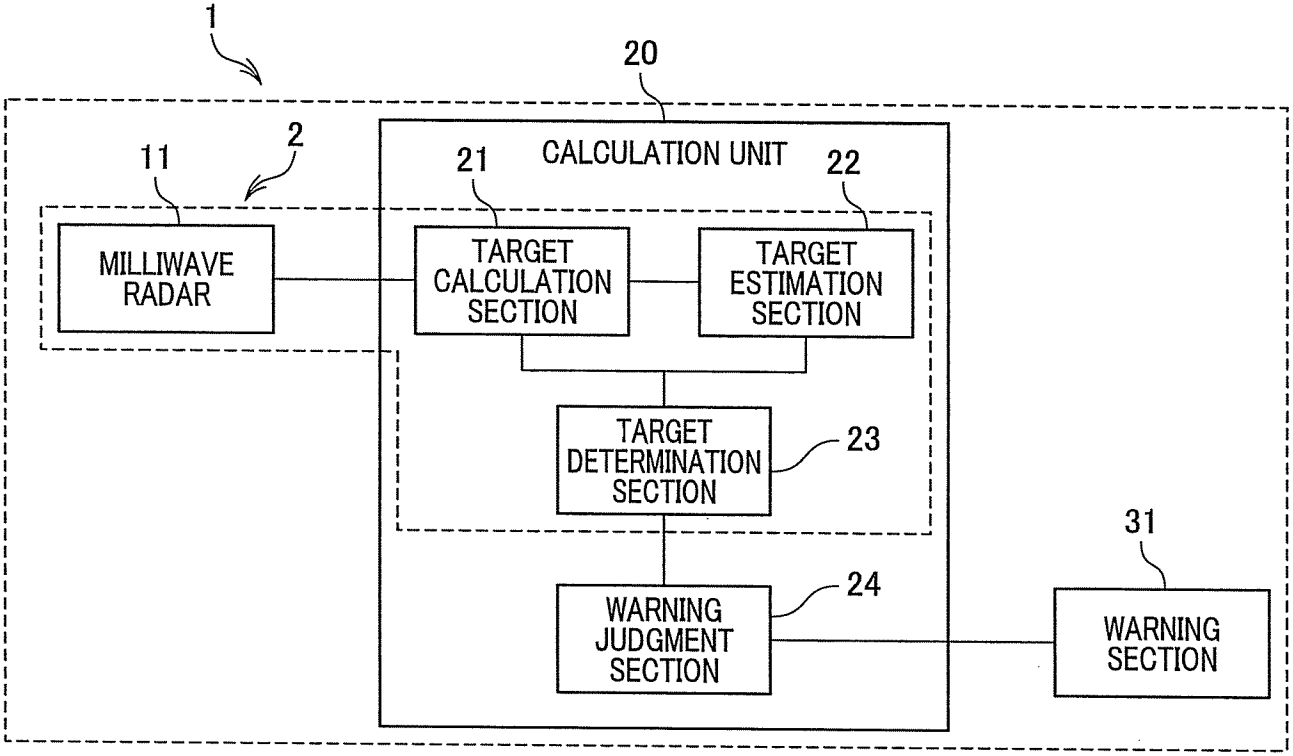
FIG. 2 shows a block diagram illustrating a configuration of the apparatus for giving a warning in changing cruising lane illustrated in FIG. 1.

As shown in a block diagram of FIG. 2, the warning apparatus 1 mainly includes a milliwave radar 11 as a radar sensor (corresponds to a "detection section"), a calculation unit 20 and a warning section 31. The calculation unit 20 includes a target calculation section 21, a target estimation section (corresponds to an "estimation section") 22, a target determination section (corresponds to a "determination section") 23 and a warning judgment section (corresponds to a "judgment section") 24. The detection apparatus 2 is included in the warning apparatus 1. The detection apparatus 2 is mainly configured by the milliwave radar 11, and the target calculation section 21, the target estimation section 22 and the target determination section 23.

The milliwave radar 11 is a radar sensor installed in the vehicle 41 at its right-rear end and/or its left-rear end. In FIG. 1, the blind spot extending obliquely rearward on the right of the vehicle 41 includes a high-accuracy detection area 61 (hereinafter referred to as "high-accuracy area 61" which corresponds to the "first detection area") and a low-accuracy detection area 62 (hereinafter referred to as "low-accuracy area 62" which corresponds to the "second detection area"). For example, the milliwave radar 11 mounted to the right-rear end of the vehicle 41 detects a target, as represented by the vehicle 42, which is present in the high- and low-detection areas 61 and 62. Specifically, the milliwave radar 11 acquires information, such as a direction of the vehicle 42 and a distance thereto as viewed from the milliwave radar 11 (this information is simply referred to as "position"). With this information, the position of the target (i.e. vehicle 42) as viewed from the vehicle 41 can be specified. A concept of the vehicle 42 may include two-wheel vehicle as well as a four-wheel vehicle.

In the present embodiment, as shown in FIG. 1, the high-accuracy area 61 and low-accuracy area 62 are applied, to an example in which these areas are adjacent to each other and extend obliquely rearward on the right. In the example shown in FIG. 1, the low-accuracy area 62 is positioned outside (i.e. right side) the high-accuracy area 61 as viewed from the vehicle 41.

In the high-accuracy area 61, the milliwave radar 11 is able to detect the vehicle 42 with higher position detection accuracy compared to the accuracy in the low-accuracy area 62. In the embodiment shown in FIG. 1, the high-accuracy area 61 extends like a fan from the milliwave radar 11 in an obliquely rearward direction on the right of the vehicle 41. As will be seen from FIG. 1, the high-accuracy area 61 covers a larger portion of the passing lane 52 than the low-accuracy area 62 does, in the rearward direction on the right of the vehicle 41.

In the low-accuracy area 62, the milliwave radar 11 is able to detect the vehicle 42 but with lower position detection accuracy than in the high-accuracy area 61. As will be seen from FIG. 1, the low-accuracy are 62 is adjacent to the high-accuracy area 61 and covers a smaller portion of the passing lane 52 than the high-accuracy area 61 does, in the rearward direction on the right of the vehicle 41.

The calculation unit 20 is configured by a microcomputer that includes a CPU (central processing unit), ROM, RAM and input/output interface, not shown. The ROM, for example, stores a control program that allows the CPU to function as the target calculation section 21, the target estimation section 22, the target determination section 23 or the warning judgment section 24.

The target calculation section 21 (corresponds to "calculation section") calculates the position of the vehicle 42 on the basis of the position information (direction and distance) acquired by the milliwave radar 11. As shown in FIG. 1, the milliwave radar 11 detects a plurality of sampling points (see seven positions shown by hatched circles in FIG. 1) which belong to the vehicle 42. Thus, the target calculation section 21 calculates a target position 71 which represents the position of the vehicle 42 (see a hatched square in FIG. 1), on the basis of the sampling points. The method of calculating the target position is not particularly limited but may be a well-known method.

In the present embodiment, the target position calculated on the basis of the sampling points in the high-accuracy area 61 is referred to as a high-accuracy target position (first target position) 71. Also, the target position calculated on the basis of the sampling points in the low-accuracy area 62 is referred to as a low-accuracy target position (second target position) 72.

The target estimation section 22 performs calculation for the estimation of a target position of the moment on the basis of a previous target position calculated by the target calculation section 21. More specifically, the target estimation section 22 calculates a high-accuracy estimated position (first estimated position) 81 on the basis of the high-accuracy target position 71 of the past and also calculates a low-accuracy estimated position (second estimated position) on the basis of the low-accuracy target position 72 of the past. The method of target's estimation (i.e. calculation) performed by the target estimation section 22 is not particularly limited but may be a well-known method.

The target determination section 23 adopts a target position to be used for judging whether or not the vehicle 42 has entered the warning area from among the high-accuracy target position 71, the low-accuracy target position 72, the high-accuracy estimated position 81 and the low-accuracy estimated position. The method of adopting a target position performed by the target determination section 23 will be described later.

The warning judgment section 24 judges whether or not the vehicle 42 has entered the warning area using the target position which has been adopted by the target determination section 23. As a result of the judgment, if the vehicle 42 is judged as being present in the warning area, the warning judgment section 24 generates a control signal for instructing the warning section 31 to give a warning. The calculation process used for judging whether or not the position of the vehicle 42 is in the warning area is not particularly limited but may be a well-known calculation process.

The warning section 31 notifies the driver of the vehicle 41 that the vehicle 42 is present in the warning area on the basis of the control signal which has been outputted from the warning judgment section 24. The warning section 31 may give a warning or alarm in the form of sound or voice, flashing light, or vibration. The warning method is not particularly limited.

Referring to FIGS. 3 to 8, hereinafter is described a calculation process in the warning apparatus 1, including, in particular, the case where the vehicle 42 moves from the high-accuracy area 61 to the low-accuracy area 62 of the milliwave radar 11.

While the vehicle 41 runs, the warning apparatus 1 repeatedly performs, at a predetermined cycle, the process of calculating a target position and an estimated position of the vehicle 42 which is present in the high- and low-accuracy areas 61 and 62.

Figure 3:
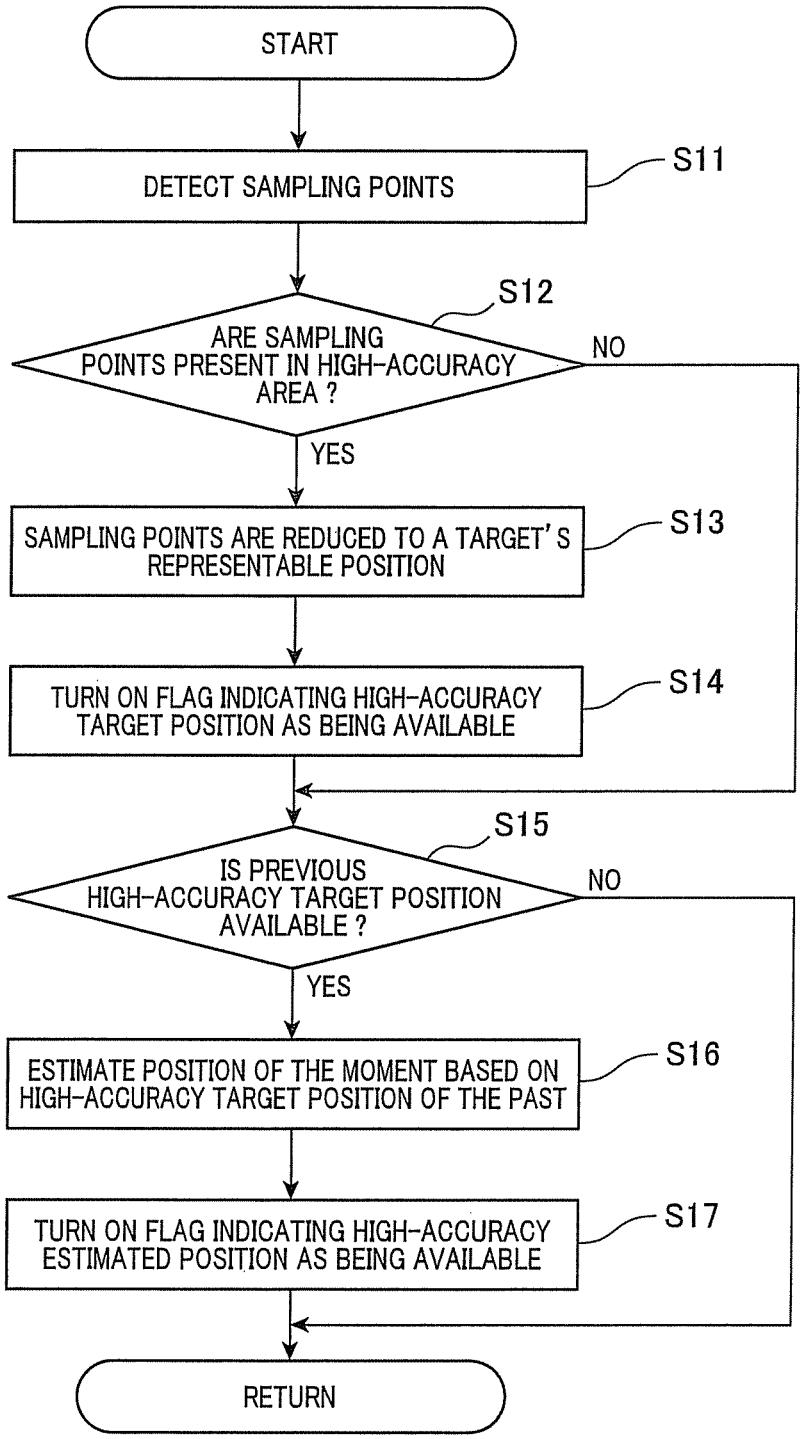
FIG. 3 shows a flow diagram illustrating a process of calculating a target position and an estimated position in a high-accuracy area.

The process of calculating a target position and an estimated position of the vehicle 42 which is present in the high-accuracy area 61 is performed according to a flow diagram shown in FIG. 3. First, the target calculation section 21 detects sampling points on the basis of position information of the vehicle 42, which is inputted from the milliwave radar 11 (step S11). Then, it is judged whether or not the detected sampling points are present in the high-accuracy area 61 (step S12).

If the sampling points are judged to be present in the high-accuracy area 61 ("YES" at step S12), the target calculation section 21 calculates a target's representable position using sampling points (step S13). The target position acquired by this processing corresponds to the high-accuracy target position 71. The target calculation section 21 turns on a flag indicating the high-accuracy target position 71 as being available (i.e. present) and also stores the high-accuracy target position 71 in the RAM (not shown) of the calculation unit 20 (step S14).

Subsequent to step S14, or if, at the judgment step S12, the sampling points are judged as not being present in the high-accuracy area 61 ("NO" at step 12), the target estimation section 22 judges whether or not the high-accuracy target position 71 of the past is available (step S15). In other words, the target estimation section 22 judges whether or not the flag indicating a high-accuracy position as being available is turned on. If the high-accuracy target position 71 of the past is judged as not being available ("NO" at step S15), control returns to step S11 to repeat the steps described above.

If the high-accuracy target position 71 of the past is judged to be available ("YES" at step S15), the target estimation section 22 uses the high-accuracy target position 71 of the past as a basis to perform a calculation for estimating the position of the vehicle 42 of the moment (step S16). Specifically, the target estimation section 22 retrieves the high-accuracy target position 71 of the past stored in the RAM and estimates the high-accuracy estimated position 81, which is the position of the vehicle 42 of the moment, from the retrieved high-accuracy target position 71.

After that, the target estimation section 22 turns on a flag indicating the high-accuracy estimated position 81 as being available and stores the high-accuracy estimated position 81 in the RAM of the calculation unit 20 (step S17). Then, control returns to step S11 to repeat the steps described above.

Figure 4:
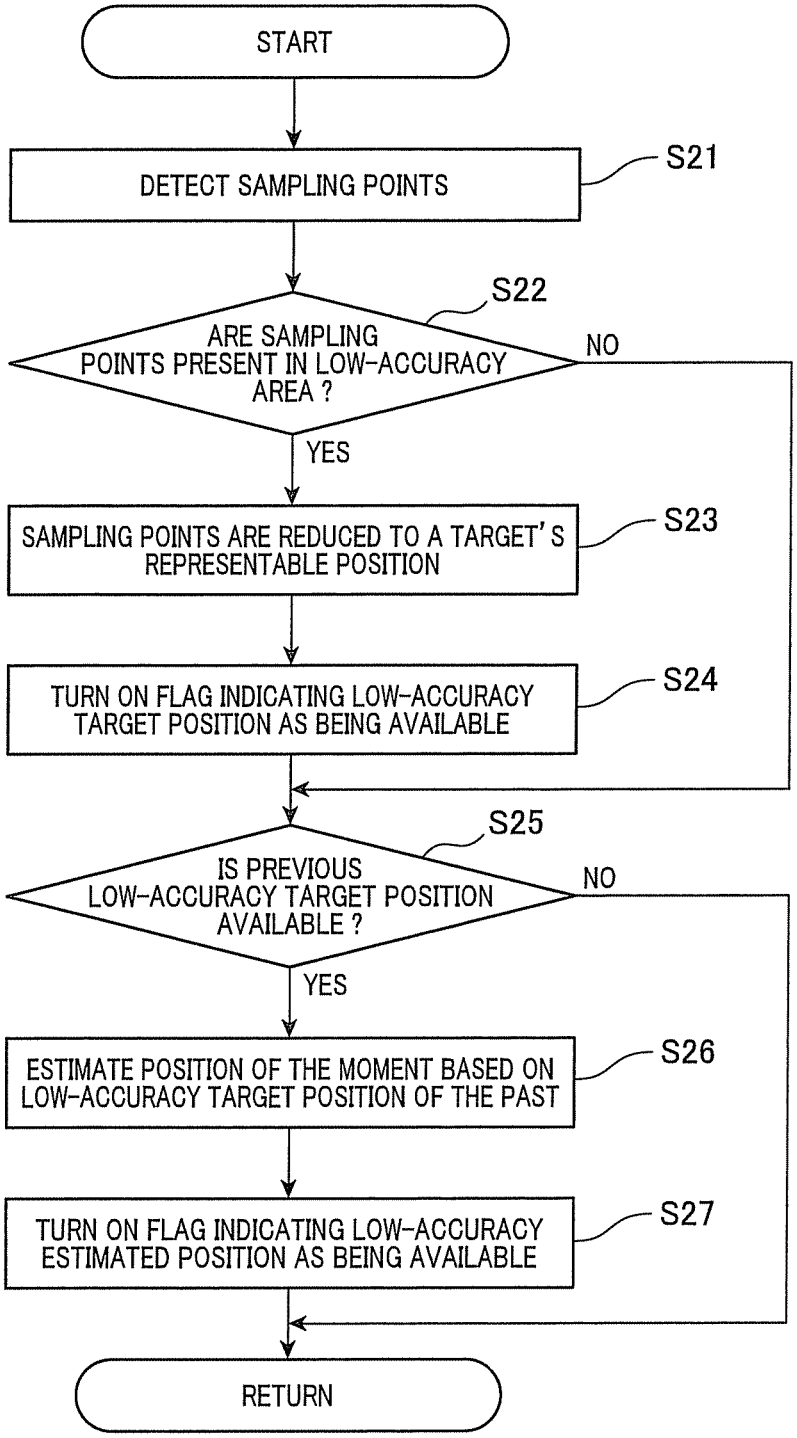
FIG. 4 shows a flow diagram illustrating a process of calculating a target position and an estimated position in a low-accuracy area.

The process of calculating a target position and an estimated position of the vehicle 42 present in the low-accuracy area 62 is performed according to a flow diagram shown in FIG. 4. First, the target calculation section 21 detects sampling points based on position information of the vehicle 42, which is inputted from the milliwave radar 11 (step S21). Then, it is judged whether or not the detected sampling points are present in the low-accuracy area 62 (step S22).

If the sampling points are judged to be present in the low-accuracy, area 62 ("YES" at step S22), the target calculation section 21 calculates a target's representable position using sampling points (step S23). The target position acquired by this processing corresponds to the low-accuracy, target position 72. The target calculation section 21 turns on a flag indicating the low-accuracy target position 72 as being available and also stores the low-accuracy target position 72 in the RAM of the calculation unit 20 (step S24).

Subsequent to step S24, or if, at the judgment step S22, the sampling points are judged as not being present in the low-accuracy area 62 ("NO" at step 22), the target estimation section 22 judges whether or not the low-accuracy target position 72 of the past is available (step S25). If the low-accuracy target position 72 of the past is judged as not being available. ("NO" at step S25), control returns to step S21 to repeat the steps described above.

If the low-accuracy target position 72 of the past is judged to be available ("YES" at step S25), the target estimation section 22 uses the low-accuracy target position 72 of the past as a basis to perform a calculation for estimating the position of the vehicle 42 of the moment (step S26). Specifically, the target estimation section. 22 retrieves the low-accuracy target position 72 of the past stored in the RAM and estimates a low-accuracy estimated position, which is the position of the vehicle 42 of the moment, from the retrieved low-accuracy target position 72.

After that, the target estimation section 22 turns on a flag indicating a low-accuracy estimated position as being available and stores the low-accuracy estimated position in the RAM of the calculation unit 20 (step S27). Then, control returns to step S21 to repeat the steps described above.

The following processes are also performed in parallel with the processes described above for calculating a target position and an estimated position of the vehicle present in the high- and low-accuracy areas 61 and 62. The parallelly performed processes include a process of selecting and adopting a target position used for judging whether or not the vehicle 42 has entered the warning area, and a process of giving a warning on the basis of the adopted target position.

Figure 5:
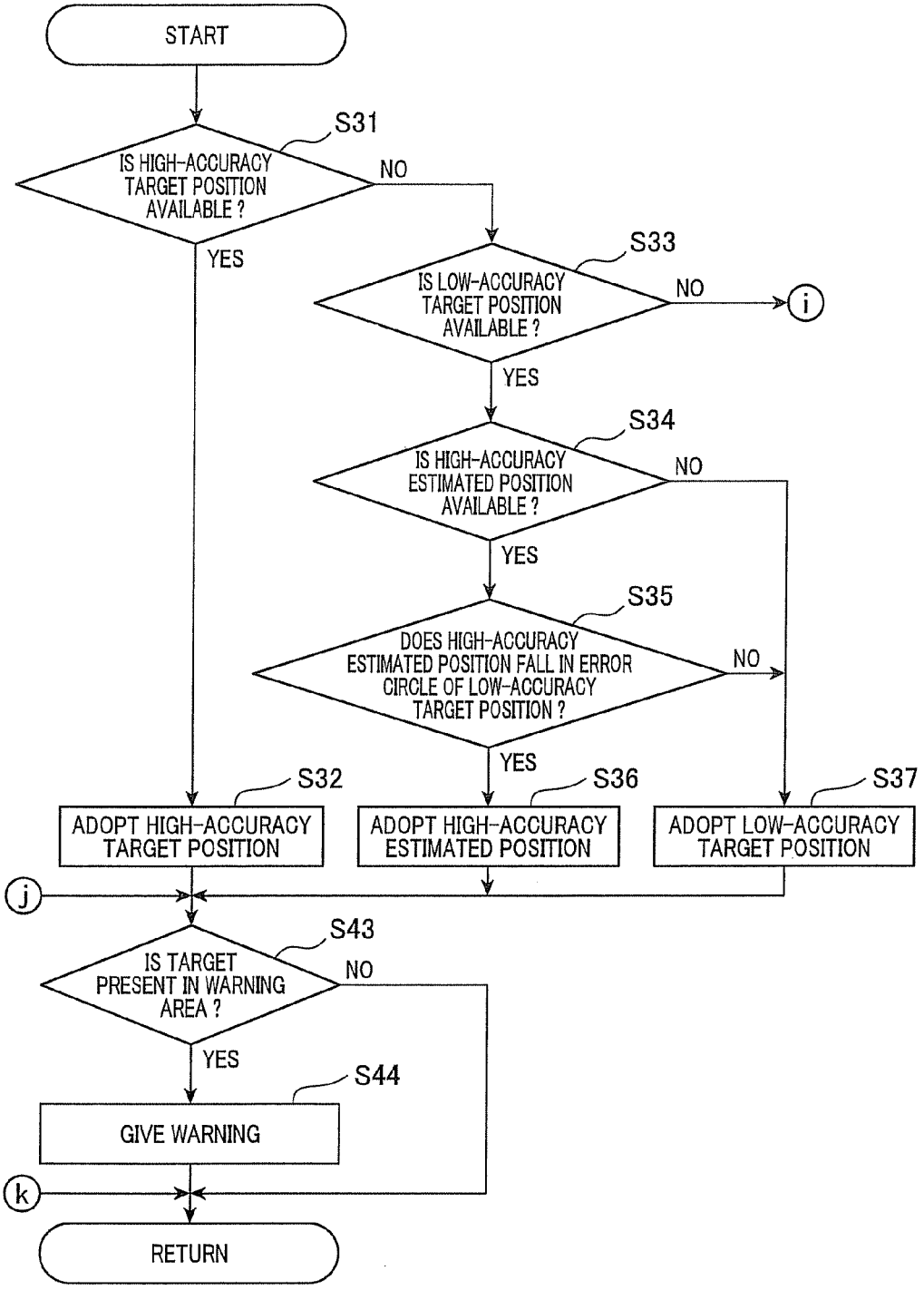
FIG. 5 shows a flow diagram illustrating a process of selecting and adopting a target position and a process of giving a warning based on the adopted target position.
Figure 6:
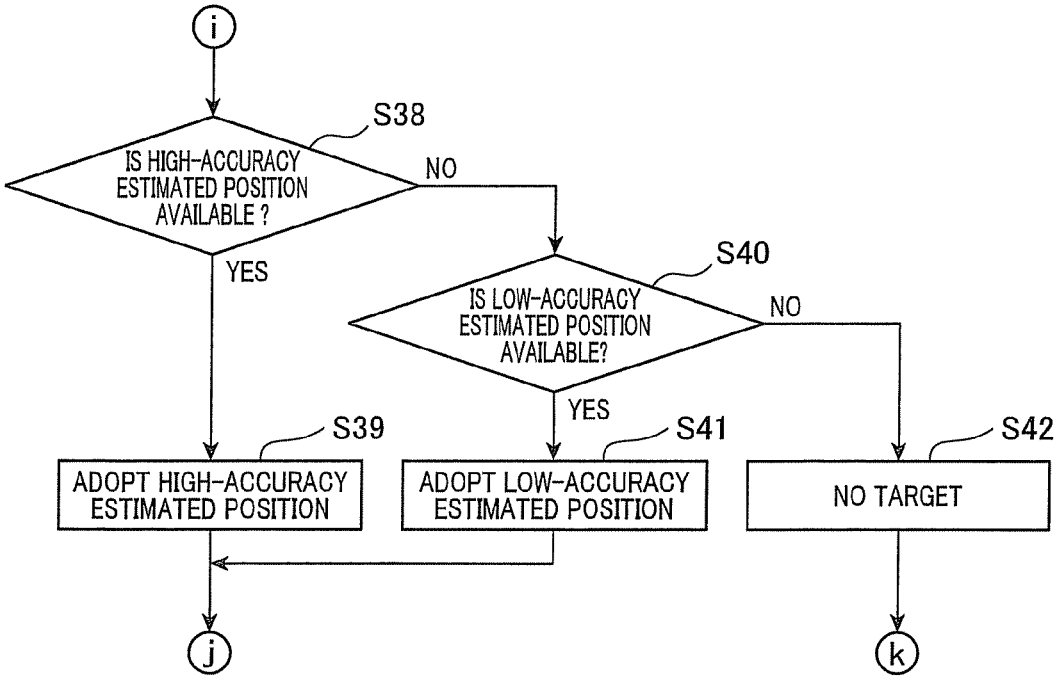
FIG. 6 shows a continuation of the flow diagram illustrated in FIG. 5.

The process of selecting and adopting a target position and a process of giving a warning on the basis of the adopted target position are performed according to a flow diagram shown in FIGS. 5 and 6. First, the target determination section 23 judges whether or not the high-accuracy target position 71 is available (step S31). In other words, the target determination section 23 judges whether or not the flag indicating the high-accuracy target position 71 as being available is turned on.

If the high-accuracy target position 71 is judged to be available ("YES" at step S31), the target determination section 23 adopts the high-accuracy target position 71 as a target position for use in the process of giving a warning (step S32). For example, this is a processing, as shown in FIG. 1, performed in the case where the vehicle 42 is present in the high-accuracy area 61.

At the judgment step S31, if the high-accuracy target position 71 is judged as not being available ("NO" at step S31), the target determination section 23 judges whether or not the low-accuracy target position 72 is available (step S33). In other words, the target determination section 23 judges whether or not the flag indicating the low-accuracy target position 72 as being available is turned on.

If the low-accuracy target position 72 is judged to be available ("YES" at step S33), the target determination section 23 judges whether or not the high-accuracy estimated position 81 is available (step S34). In other words, the target determination section 23 judges whether or not the flag indicating the high-accuracy estimated position 81 as being available is turned on. For example, this is a processing, as shown in FIG. 7 or 8, performed when the vehicle 42 has entered the low-accuracy area 62.

If the high-accuracy estimated position 81 is judged to be available ("YES" at step S34), the target determination section 23 judges whether or not the position of the vehicle 42 indicated by the high-accuracy estimated position 81 is in an error circle (predetermined range) 73 centering on the position of the vehicle 42 indicated by the low-accuracy target position 72 (step S35). The size of the error circle 73 depends on the accuracy of the low-accuracy target position 72, or, in other words, depends on the detection accuracy exerted by the milliwave radar 11 in the low-accuracy area 62.

Figure 7:
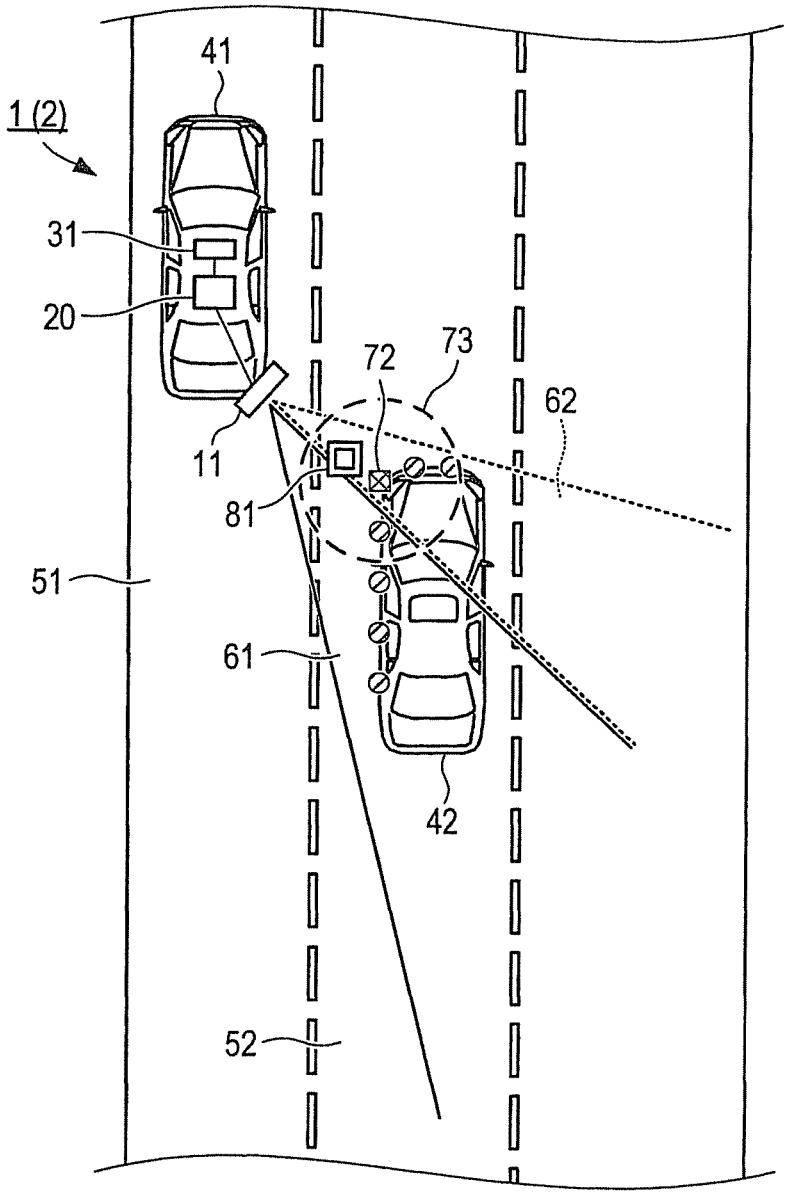
FIG. 7 shows a schematic diagram illustrating a situation in which a nearby vehicle enters a low-accuracy area and a high-accuracy estimated position is in an error circle.
Figure 8:
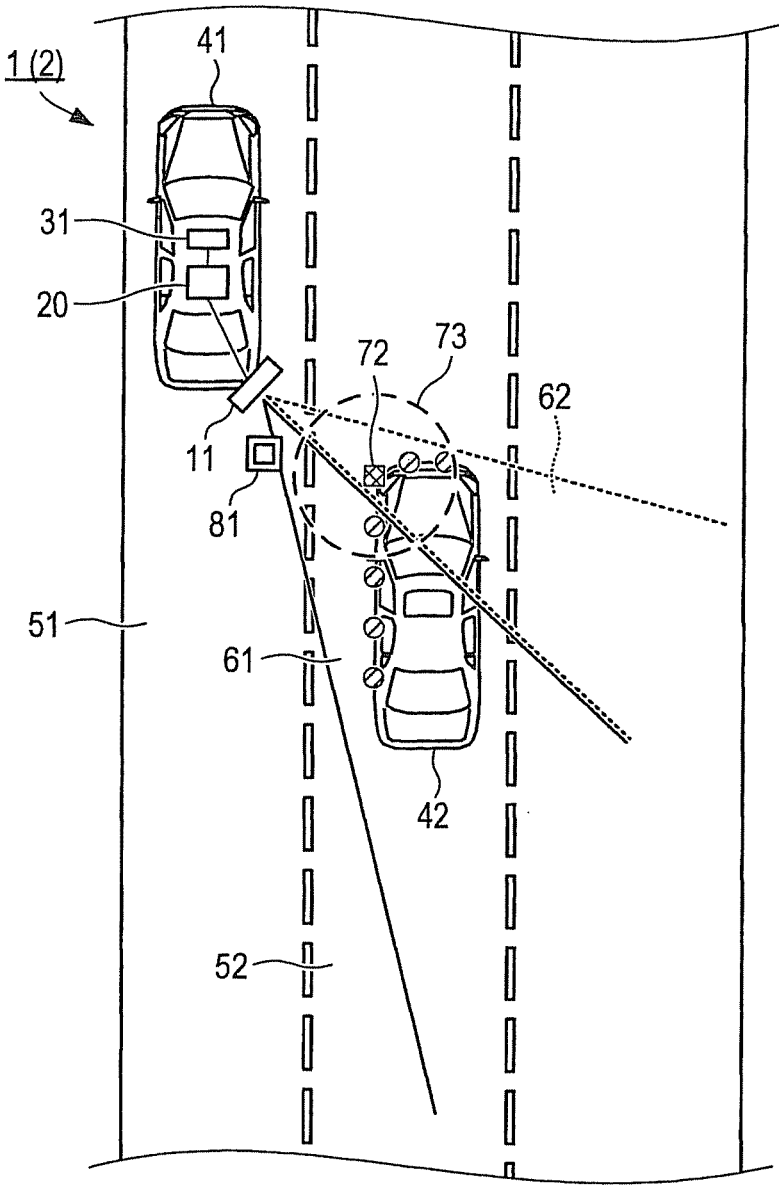
FIG. 8 shows a schematic diagram illustrating a situation in which a nearby vehicle enters a low-accuracy area and a high-accuracy estimated position is not in an error circle.

If the high-accuracy estimated position 81 is judged to be present in the error circle 73 of the low-accuracy target position 72 ("YES" at step S35) as shown in FIG. 7, the target determination section 23 adopts the high-accuracy estimated position 81 as target information for use in the process of giving a warning (step S36).

On the other hand, at step S34, if the high-accuracy estimated position 81 is judged not to be available ("NO" at step S34), the target determination section 23 adopts the low-accuracy target position 72 as target information for use in the process of giving a warning (step S37). If the high-accuracy estimated position 81 has been judged, at step S35, as not being present in the error circle 73 of the low-accuracy target position 72 ("NO" at step S35), as well, as shown in FIG. 8, the target determination section 23 adopts the low-accuracy target position 72 as target information for use in the process of giving a warning (step S37).

If it is judged, at step S33, that the low-accuracy target position 72 is not available ("NO" at step S33), the target determination section 23 judges, as shown in FIG. 6, whether or not the high-accuracy estimated position 81 is available (step S38). If the high-accuracy estimated position 81 is judged to be available ("YES" at step S38), the target determination section 23 adopts the high-accuracy estimated position 81 as target information for use in the process of giving a warning (step S39).

If it is judged; at step S38, that the high-accuracy estimated position 81 is not available ("NO" at step S38), the target determination section 23 judges whether or not a low-accuracy estimated position is available (step S40). If a low-accuracy estimated position is judged to be available ("YES" at step S40), the target determination section 23 adopts the low-accuracy estimated position as target information for use in the process of giving a warning (step S41). If it is judged, at step S40, that the low-accuracy estimated position is not available ("NO" at step S40), the target determination section 23 judges that there is no target position for use in the process of giving a warning (step S42). Then, control returns to step S31 of FIG. 5 to repeat the steps described above.

If target information for use in the process of giving a warning is adopted at step S32, S36, S37, S39 or S41 by the target determination section 23, the warning judgment section 24 judges whether or not the target position is present in the warning area (step S43). If the target position is judged to be present in the warning area ("YES" at step S43), a control signal is outputted from the warning judgment section 24 to the warning section 31 to give a warning to the driver (step S44). On the other hand, if the target position is judged not to be present in the warning area ("NO" at step S43), control returns to step S31 to repeat the steps described above.

According to the warning apparatus 1 (the detection apparatus 2) having the configuration described above, the high-accuracy estimated position 81 is adopted as position information of the vehicle 42 if the high-accuracy estimated position 81 is included in the error circle 73 centering on the low-accuracy target position 72 (steps S35 and S36). On the other hand, the warning apparatus 1 (the detection apparatus 2) adopts the low-accuracy target position 72 as position information of the vehicle 42 if the high-accuracy estimated position 81 is outside the error circle 73 (steps S35 and S37). With this configuration, the detection accuracy can be enhanced with respect to the vehicle 42 in the low-accuracy area 62.

The low-accuracy target position 72 and the high-accuracy estimated position 81 have an error compared to the actual position of the vehicle 42. The high-accuracy estimated position 81 tends to have a larger error in proportion to the time elapsed from the start of the estimation. The degree of error of the low-accuracy target position 72 is substantially constant irrespective of the elapsed time, but is larger than the error that the high-accuracy estimated position 81 may have before the expiration of a predetermined time from the start of the estimation.

Therefore, if the high-accuracy estimated position 81 is included in the error circle 73 centering on the low-accuracy target position 72, the high-accuracy estimated position 81 having a relatively small error is adopted as the position of the vehicle 42 (steps S35 and S36). On the other hand, if the high-accuracy estimated position 81 is outside the error circle 73, the low-accuracy target position 72 having a relatively large error is adopted as the position of the vehicle 42 (steps S35 and S37). With this configuration, the detection accuracy is enhanced with respect to a target in the low-accuracy area 62.

If the high-accuracy estimated position 81 is not available, the low-accuracy target position 72 is adopted as the position of the vehicle 42 (steps S34 and S37). This can prevent the creation, of a condition where position information of the vehicle 42 is not available.

In the event that the high- or low-accuracy target position 71 or 72 cannot be acquired, the high-accuracy estimated position 81 is adopted as the position of the vehicle 42 (step S39) to thereby prevent the creation of a condition where position information of the vehicle 42 is not available.

Further, in the event that neither the high- or low-accuracy target position 71 or 72, nor the high-accuracy estimated position 81 is available, a low-accuracy estimated position is adopted as the position of the vehicle 42 (step S41) to thereby prevent the creation of a condition where position information of the vehicle 42 is not available.

As the information related to the vehicle 42, the position information of the vehicle 42 may be acquired as in the embodiment described above, or the speed information of the vehicle 42 may be acquired. No limitation shall be imposed on the information to be acquired regarding the vehicle 42.

Figure 9:
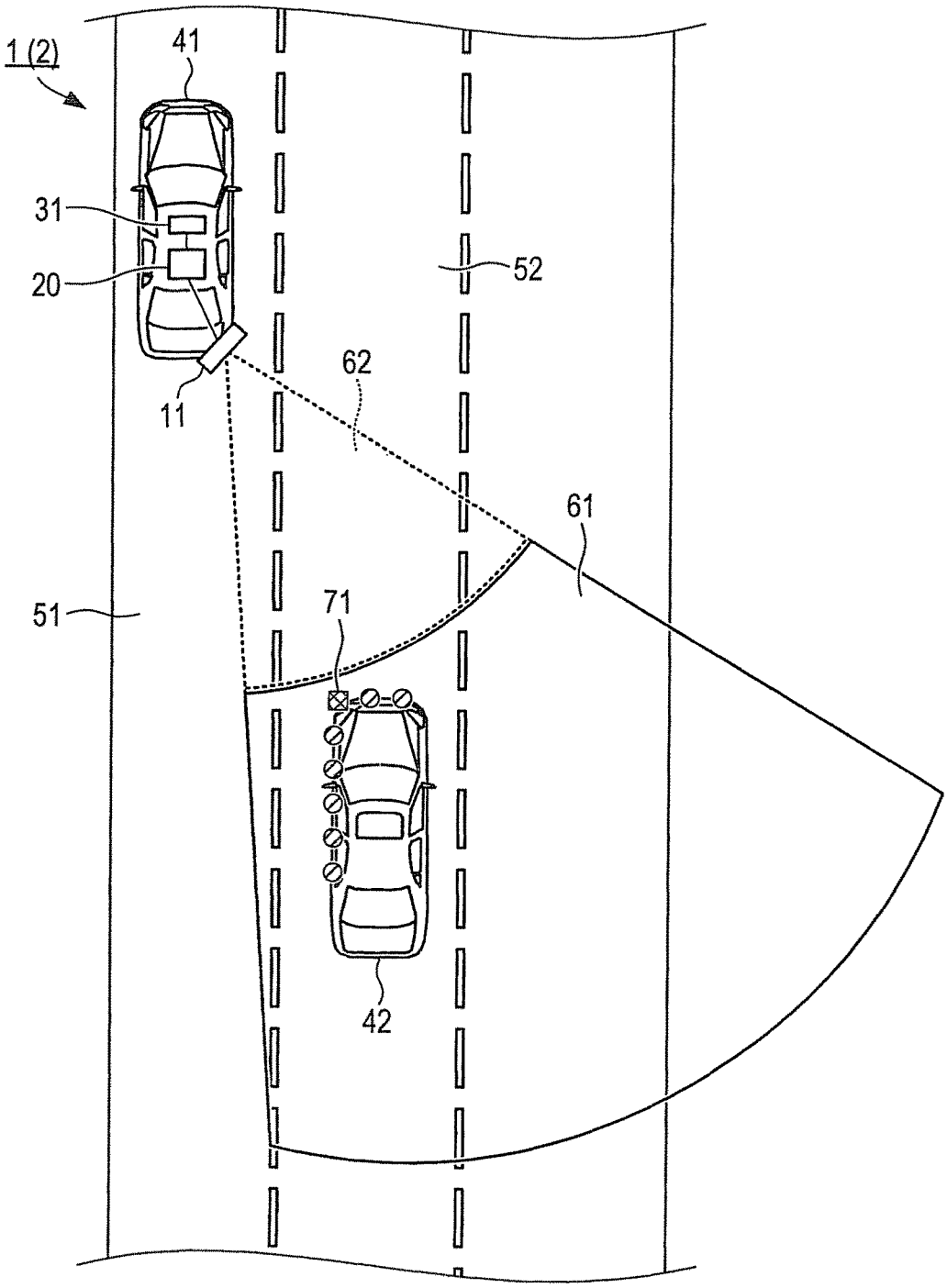
FIG. 9 shows a schematic diagram illustrating another example of a high-accuracy area and a low-accuracy area.

As in the embodiment described above, the high- and low-accuracy areas 61 and 62 may be juxtaposed side by side as shown in FIG. 1. Alternative to this, as shown in FIG. 9, the low-accuracy area 62 may be provided closer to the milliwave radar 11 and the high-accuracy area 61 may be provided farther from the milliwave radar 11. Alternatively, the low- and high-accuracy areas 62 and 61 shown in FIG. 9 may be combined with the low-accuracy area 62 shown in FIG. 1. In other words, being juxtaposed to the low- and high-accuracy areas 62 and 61 shown in FIG. 9, another low-accuracy area 62 may be arranged side by side.

What is claimed is:

1. A vehicle detection apparatus comprising:

a detection section of the vehicle detection apparatus which is mounted to a vehicle and detects, with a predetermined accuracy, a first target position of a target when the target is present in a first detection area that extends obliquely rearward of the vehicle, and also detects, with an accuracy lower than the predetermined accuracy, a second target position of the target when the target is present in a second detection area different from and immediately adjacent to the first detection area, the adjacent first and second detection areas being simultaneously set and used; and a controller comprising:

an estimation section which is mounted to the vehicle and calculates a first estimated position based on the detected first target position, the first estimated position corresponding to a first subsequent position of the target; and a determination section which is mounted to the vehicle and adopts the first estimated position as a position of the target when the first estimated position is included in a predetermined range centering on the second target position, and adopts the second target position as the position of the target when the first estimated position is outside the predetermined range; wherein the second detection area is configured as a range in which a desired detection accuracy is ensured;

the second target position and the first estimated position have a degree of error compared to an actual position of the target;

the degree of error of the first estimated position becomes larger in proportion to the time elapsed from a start of the estimation;

the degree of error of the second target position is constant, irrespective of the time elapsed from the start of the estimation but is larger than the degree of error of the first estimated position before expiration of a predetermined time from the start of the estimation;

when the first estimated position is included in the predetermined range centering on the second target position, the first estimated position has a first degree of error and the first estimated position is adopted as the position of the target;

when the first estimated position is outside the predetermined range, the second target position has a second degree of error larger than the first degree of error and the second target position is adopted as the position of the target.

2. The vehicle detection apparatus according to claim 1, wherein the determination section, when the detection section has detected the target's potion in the second detection area and the first estimated position is not available, adopts the second target's position as the position of the target.

3. The vehicle detection apparatus according to claim 2, wherein the determination section, even though the determination section could not detect the target in the first detection area and the second detection area, when the first estimated position is available, adopts the first estimated position as the position of the target.

4. The vehicle detection apparatus according to claim 3, wherein the estimation section further calculates a second estimated position based on the detected second target position, the second estimated position corresponding to a second subsequent position of the target detected by the detection section, based on the detected second target position; and the determination section, when the first estimated position cannot be available, adopts the second estimated position as the position of the target.

5. The vehicle detection apparatus according to claim 4, wherein the detection section detects a plurality of sampling points which belong to the target; and the apparatus further comprises a calculation section which is mounted to the vehicle and calculates the target's representable position on the basis of the sampling points previously acquired by the detection section.

6. A warning apparatus comprising:

a vehicle detection apparatus comprising:

a detection section of the vehicle detection apparatus which is mounted to a vehicle and detects, with a predetermined accuracy, a first target position of a target when the target is present in a first detection area that extends obliquely rearward of the vehicle, and also detects, with an accuracy lower than the predetermined accuracy, a second target of the target when the target is present in a second detection area different from and immediately adjacent to the first detection area, the adjacent first and second detection areas being simultaneously set and used; and a controller comprising:

an estimation section which is mounted to the vehicle and calculates a first estimated position based on the detected first target position, the first estimated position corresponding to a first subsequent position of the target; and a determination section which is mounted to the vehicle and adopts the first estimated position as a position of the target when the first estimated position is included in a predetermined range centering on the second target position, and adopts the second target position as the position of the target when the first estimated position is outside the predetermined range, a judgment section which is mounted to the vehicle and judges whether or not information adopted by the determination section meets a warning condition; and a warning section which is mounted to the vehicle and generates an alarm in a case where the judgment section has judged that the warning condition is satisfied;

wherein the second detection area is configured as a range in which a desired detection accuracy is ensured;

the second target position and the first estimated position have a degree of error compared to an actual position of the target;

the degree of error of the first estimated position becomes larger in proportion to the time elapsed from a start of the estimation;

the degree of error of the second target position is constant, irrespective of the time elapsed from the start of the estimation but is larger than the degree of error of the first estimated position before expiration of a predetermined time from the start of the estimation;

when the first estimated position is included in the predetermined range centering on the second target position, the first estimated position has a first degree of error and the first estimated position is adopted as the position of the target;

when the first estimated position is outside the predetermined range, the second target position has a second degree of error larger than the first degree of error and the second target position is adopted as the position of the target.

7. The warning apparatus according to claim 6, wherein the alarm is performed by any one of sound, light or vibration, or combination thereof.

8. A vehicle detection method comprising:

detecting, by a detection section of a vehicle detection apparatus mounted to a vehicle, with a predetermined accuracy, a first target position of a target when the target is present in a first detection area that extends obliquely rearward of the vehicle;

detecting, by the detection section, with an accuracy lower than the predetermined accuracy, a second target position of the target when the target is present in a second detection area different from and immediately adjacent to the first detection area, the adjacent first and second detection areas being simultaneously set and used;

calculating, by an estimation section of a controller mounted to the vehicle, as a first estimated position based on the detected first target position, the first estimated position corresponding to a first subsequent position of the target;

adopting, by a determination section of the controller mounted to the vehicle, the first estimated position as a position of the target when the first estimated position is included in a predetermined range centering on the second target position; and adopting, by the determination section, the second target position as the position of the target when the first estimated position is outside the predetermined range;

wherein the second detection area is configured as a range in which a desired detection accuracy is ensured;

the second target position and the first estimated position have a degree of error compared to an actual position of the target;

the degree of error of the first estimated position becomes larger in proportion to the time elapsed from a start of the estimation;

the degree of error of the second target position is constant, irrespective of the time elapsed from the start of the estimation but is larger than the degree of error of the first estimated position before expiration of a predetermined time from the start of the estimation;

when the first estimated position is included in the predetermined range centering on the second target position, the first estimated position has a first degree of error and the first estimated position is adopted as the position of the target;

when the first estimated position is outside the predetermined range, the second target position has a second degree of error larger than the first degree of error and the second target position is adopted as the position of the target.

9. The vehicle detection method according to claim 8, wherein when the detection section has detected the target's potion in the second detection area and the first estimated position is not available, adopts, by the determination section, the second target's position as the position of the target.

10. The vehicle detection method according to claim 9, wherein even though the target in the first detection area and the second detection area have not been detected, when the first estimated position is available, adopts, by the determination section, the first estimated position as the position of the target.

11. The vehicle detection method according to claim 10, further comprising:

calculating, by the estimation section, a second estimated position which corresponds to a second subsequent position of the target detected by the detection section, based on the detected second target position; and when the first estimated position is not available, adopts, by the determination section, the second estimated position as the position of the target.

12. The vehicle detection method according to claim 11, further comprising:

detecting, by the detection section, a plurality of sampling points which belong to the target and calculating the target's representable position on the basis of the sampling points.

13. A warning method comprising:

detecting, by a detection section of a vehicle detection apparatus mounted to a vehicle, with a predetermined accuracy, a first target position related to a target when the target is present in a first detection area that extends obliquely rearward of the vehicle;

detecting, by the detection section, with an accuracy lower than the predetermined accuracy, a second target position of the target when the target is present in a second detection area different from and immediately adjacent to the first detection area, the adjacent first and second detection areas being simultaneously set and used;

calculating, by an estimation section of a controller mounted to the vehicle, as a first estimated position based on the detected first target position, the first estimated position corresponding to a subsequent position of the target;

adopting, by a determination section of the controller mounted to the vehicle, the first estimated position as a position of the target when the first estimated position is included in a predetermined range centering on the second target position; and adopting, by the determination section, the second target position as the position of the target when the first estimated position is outside the predetermined range, judging, by a judgment section mounted to the vehicle, whether or not information adopted by the determination section meets a warning condition; and generating, by a warning section mounted to the vehicle, an alarm in a case where the warning condition is satisfied; wherein the second detection area is configured as a range in which a desired detection accuracy is ensured;

the second target position and the first estimated position have a degree of error compared to an actual position of the target;

the degree of error of the first estimated position becomes larger in proportion to the time elapsed from a start of the estimation;

the degree of error of the second target position is constant, irrespective of the time elapsed from the start of the estimation but is larger than the degree of error of the first estimated position before expiration of a predetermined time from the start of the estimation;

when the first estimated position is included in the predetermined range centering on the second target position, the first estimated position has a first degree of error and the first estimated position is adopted as the position of the target;

when the first estimated position is outside the predetermined range, the second target position has a second degree of error larger than the first degree of error and the second target position is adopted as the position of the target.

14. The warning method according to claim 13, wherein the alarm is performed by any one of sound, light or vibration, or combination thereof.

15. The vehicle detection apparatus according to claim 1, further comprising:

a judgment section which is mounted to the vehicle and judges whether or not information adopted by the determination section meets a warning condition; and a warning section which is mounted to the vehicle and generates an alarm in a case where the judgment section has judged that the warning condition is satisfied.

16. The vehicle detection apparatus according to claim 15, wherein the alarm is performed by any one of sound, light or vibration, or combination thereof.

17. The vehicle detection method according to claim 8, further comprising:

judging, by a judgment section mounted to the vehicle, whether or not information adopted by the determination section meets a warning condition; and generating, by a warning section mounted to the vehicle, an alarm in a case where the warning condition is satisfied.

18. The vehicle detection method according to claim 17, wherein the alarm is performed by any one of sound, light or vibration, or combination thereof.

19. The vehicle detection apparatus according to claim 1, wherein the detection section detects the first and second target positions in the first and second detection areas, respectively from a single detection position on the vehicle.

20. The vehicle detection apparatus according to claim 1, wherein the first and second target positions are detected using a single radar sensor.

* * * * *